US006402023B1

(12) United States Patent
Beaudry et al.

(10) Patent No.: US 6,402,023 B1
(45) Date of Patent: Jun. 11, 2002

(54) NEWSPAPER DELIVERY RECEPTACLE AND METHOD

(75) Inventors: Joseph M. Beaudry; Thomas P. Hamilton, both of Homewood, IL (US)

(73) Assignee: Hamilton Circulation Supplies, Co., Homewood, IL (US)

( * ) Notice: Subject to any disclaimer, the term of this patent is extended or adjusted under 35 U.S.C. 154(b) by 0 days.

(21) Appl. No.: 09/389,517

(22) Filed: Sep. 3, 1999

(51) Int. Cl.[7] ..... B65D 91/00

(52) U.S. Cl. ..... 232/1 C; 232/39; 232/54; 248/213.2

(58) Field of Search ..... 232/1 C, 17, 45, 232/54, 38, 39; 248/146, 213.2; 411/913

(56) References Cited

U.S. PATENT DOCUMENTS

| | | | | |
|---|---|---|---|---|
| 2,120,857 A | | 6/1938 | Crawford et al. | |
| 2,156,858 A | | 5/1939 | Landis | |
| 2,552,915 A | | 5/1951 | Zachrich | |
| 2,709,038 A | | 5/1955 | Marcus et al. | |
| 3,042,293 A | | 7/1962 | Miller | |
| 3,047,213 A | * | 7/1962 | Monroe | 232/17 |
| 3,086,674 A | * | 4/1963 | Scheuerman | 232/1 C |
| 3,154,281 A | | 10/1964 | Frank | |
| 3,181,782 A | | 5/1965 | Monroe | |
| 3,191,135 A | | 6/1965 | Hazelquist | |
| 3,556,393 A | | 1/1971 | Fibus | |
| 4,026,461 A | | 5/1977 | Hodge | |
| 4,067,529 A | | 1/1978 | Milroy | |
| 4,105,180 A | | 8/1978 | Hodge | |
| 4,114,800 A | | 9/1978 | Hodge | |
| 4,120,446 A | | 10/1978 | Fuemmeler | |
| 4,146,171 A | | 3/1979 | Hodge | |
| 4,181,250 A | | 1/1980 | Withrow | |
| 4,403,730 A | | 9/1983 | Batson | |
| 4,627,566 A | | 12/1986 | Fibus | |
| 4,644,713 A | | 2/1987 | Lehman | |
| 4,660,757 A | * | 4/1987 | Hicks | 232/1 C |
| 4,723,702 A | | 2/1988 | Martin | |
| 4,724,998 A | | 2/1988 | Long et al. | |
| 4,973,212 A | * | 11/1990 | Jacobs | 411/913 X |
| 5,076,032 A | | 12/1991 | Lehman | |
| 5,169,062 A | | 12/1992 | Baker | |
| 5,337,954 A | | 8/1994 | Kobilarcik et al. | |
| 5,586,718 A | | 12/1996 | Speece | |
| 5,593,059 A | | 1/1997 | Neilson | |
| 5,664,748 A | | 9/1997 | Speece et al. | |

* cited by examiner

*Primary Examiner*—B. Dayoan
*Assistant Examiner*—William L. Miller
(74) *Attorney, Agent, or Firm*—Thomas J. Ring; Wildman, Harrold, Allen & Dixon

(57) ABSTRACT

A newspaper delivery receptacle having a generally elongated tubular shape with a bottom wall, top wall and vertical side walls an open front end for receipt of newspapers, printer material and the like. The newspaper delivery receptacle is securable to a mounting post and has a plurality of space apart snaps which extend from an exterior surface of the receptacle and a mounting bracket having a plurality of openings which engage the snaps to fixedly secure the receptacle to the bracket.

29 Claims, 4 Drawing Sheets

FIG. 1
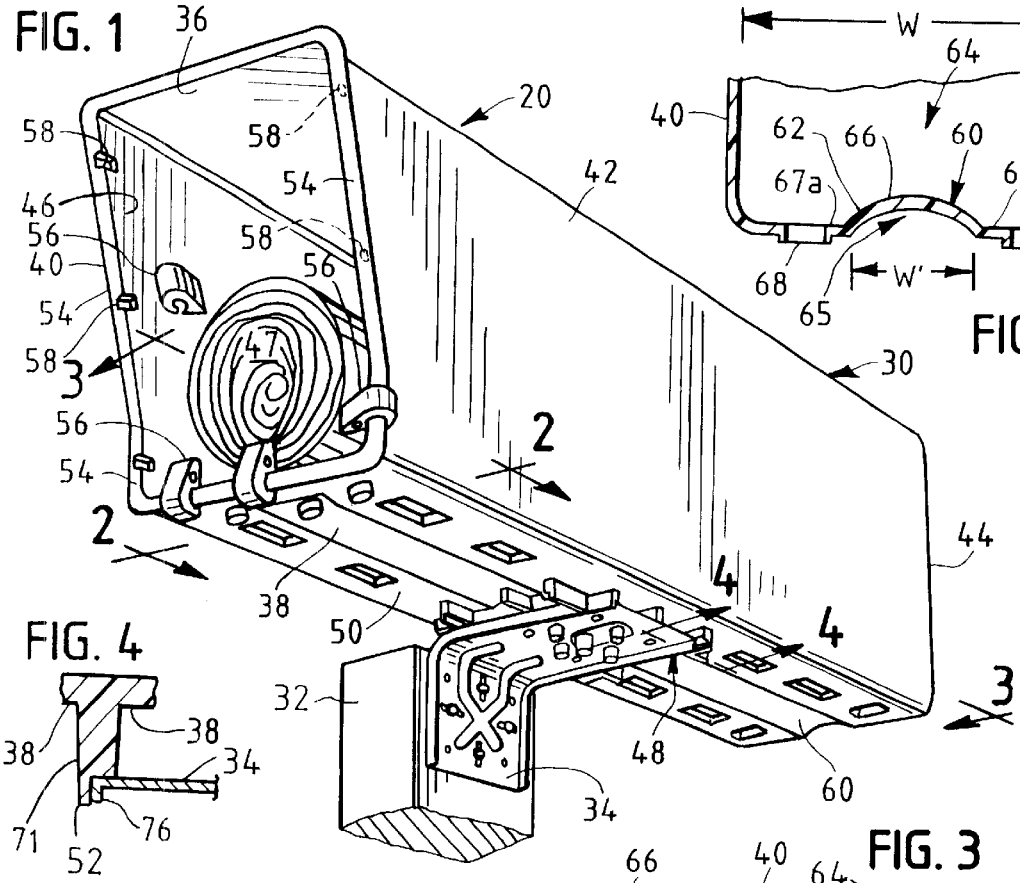
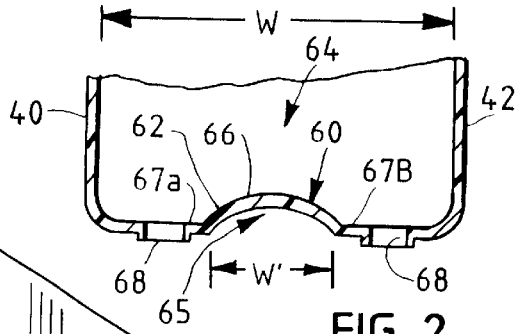
FIG. 2
FIG. 4
FIG. 3
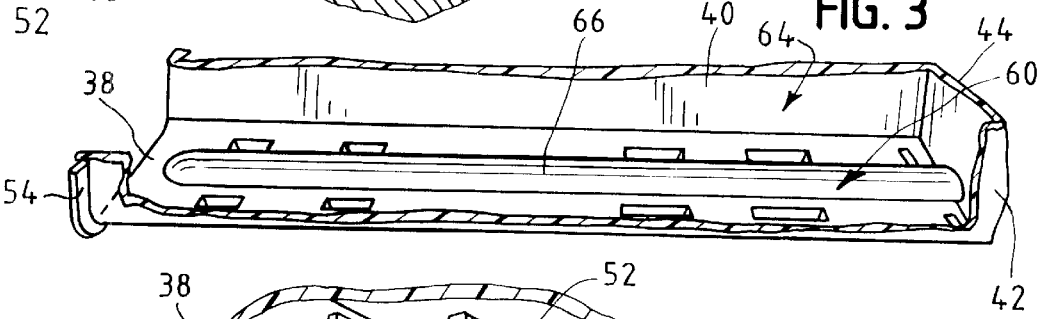
FIG. 5
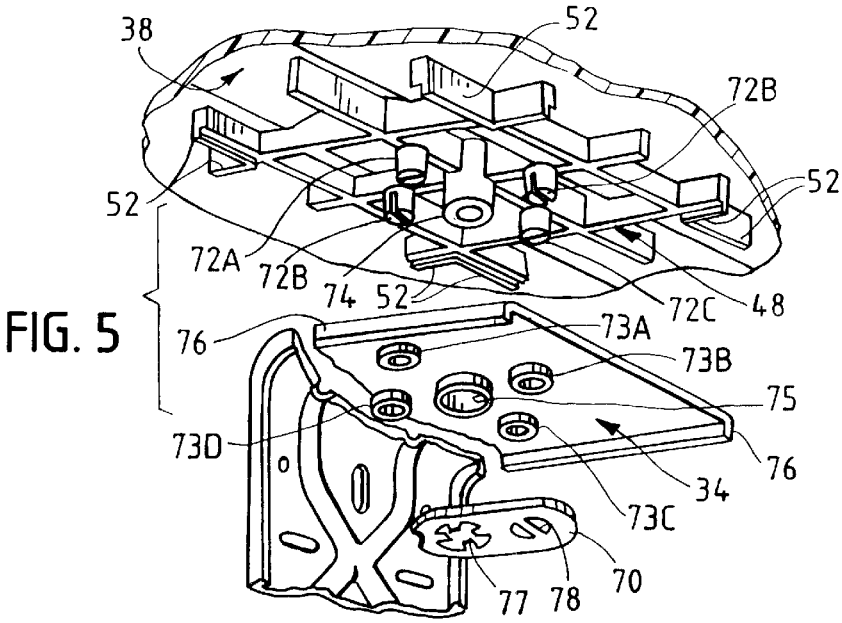

NEWSPAPER DELIVERY RECEPTACLE AND METHOD

TECHNICAL FIELD

The invention relates to newspaper delivery receptacles also commonly referred to as motor route tubes for receipt of newspapers and like materials which are inserted within the elongate receptacle upon delivery.

BACKGROUND OF THE INVENTION

Elongate tubular newspaper delivery receptacles which receive delivered newspapers and the like and which protect them against the elements are known. The receptacles are generally tubular in shape and have an opening at one end of the tube for insertion of a delivered newspaper to a subscriber, often located on a rural route. Many elongate newspaper delivery tubes have a generally rectangular or cylindrical shape and are mounted horizontally upon a vertical mounting post with the aid of a bracket securing the tube to the post.

However, such newspaper delivery tubes have been found to have certain disadvantages. In has been found that at times the inserted newspapers become inadvertently dislodged from the elongate receptacles. High winds, especially in rural areas, can blow a newspaper or other printed material from its delivery tube. Such inserted items may also be inadvertently expelled from the delivery tube upon the creation of a partial vacuum within the tube caused by a passing vehicle moving at a high speed. Attempts have been made to retain newspapers within delivery tubes such as through the employment of retaining flaps permanently molded within the tube. These attempts have been found to be inflexible and are not easily modifiable for the needs of the particular user. For example, at times, a newspaper opens up or expands upon being inserted into the tube receptacle. Unfortunately, known fixed retainers have been found to be inadequate because of their inability to be modifiable.

Additionally, many conventional delivery tube receptacles do not adequately drain water which may enter the interior region of the receptacle. Water, from rain or melted snow, unfortunately often sits at the bottom of the delivery receptacle which tends to damage a contained newspaper, often rendering its unreadable. Furthermore, conventional delivery tube receptacles often have a bracket which secures the receptacle to a support post. Securement is often performed by various hooks, inserts or tabs which tend to be complicated and which require long installation times. Moreover, securement of these known receptacles often can only be performed in one or two directions, thereby limiting its usefulness. Furthermore, certain conventional receptacle assemblies fail to provide adequate support for added resistance to prevent the receptacle from being knocked off (by vandals, snow plows, etc.) from its associated bracket.

SUMMARY OF THE INVENTION

It is an object of the present invention to provide a newspaper delivery receptacle assembly which overcomes the disadvantages of known conventional newspaper delivery receptacles. In one aspect of the present invention, a newspaper delivery tube receptacle having a bottom wall, top wall and sides is provided with a cambered bottom wall portion extending along the length of the bottom wall with a convex surface which projects from the bottom wall into an interior region of the receptacle.

The newspaper delivery receptacle further is securable to a mounting post and has a plurality of spaced apart snaps which extend from an exterior surface of the receptacle. A mounting bracket having a plurality of openings which engage the snaps is employed to fixedly secure the receptacle to the bracket. Additionally, the newspaper delivery receptacle includes a retainment member which is securable about the lip of the receptacle for preventing items inserted into the tube from being discharged through the open front end of the receptacle. An engagement member is positioned at one of the pair of sides for releasably securing the retainment member to the newspaper delivery receptacle.

BRIEF DESCRIPTION OF THE DRAWINGS

The foregoing features of the invention will be explained in greater detail and others will be made apparent from the detailed description of the present invention which is given with reference to the several figures of the drawing, in which:

FIG. 1 is a perspective view of the newspaper delivery receptacle as secured to a mounting post;

FIG. 2 is a cross sectional view of the interior bottom portion of the receptacle as viewed along line 2—2 of FIG. 1;

FIG. 3 is a broken away perspective view of the elongate newspaper delivery receptacle as viewed along line 3—3 of FIG. 1;

FIG. 4 is a fragmentary cross section of the mounting bracket engaging a guide member of the mounting assembly of the receptacle as viewed along line 4—4 of FIG. 1;

FIG. 5 is an exploded view of the mounting assembly at the bottom exterior surface of the receptacle, the mounting bracket and the bracket clip;

DETAILED DESCRIPTION

Figure 6:
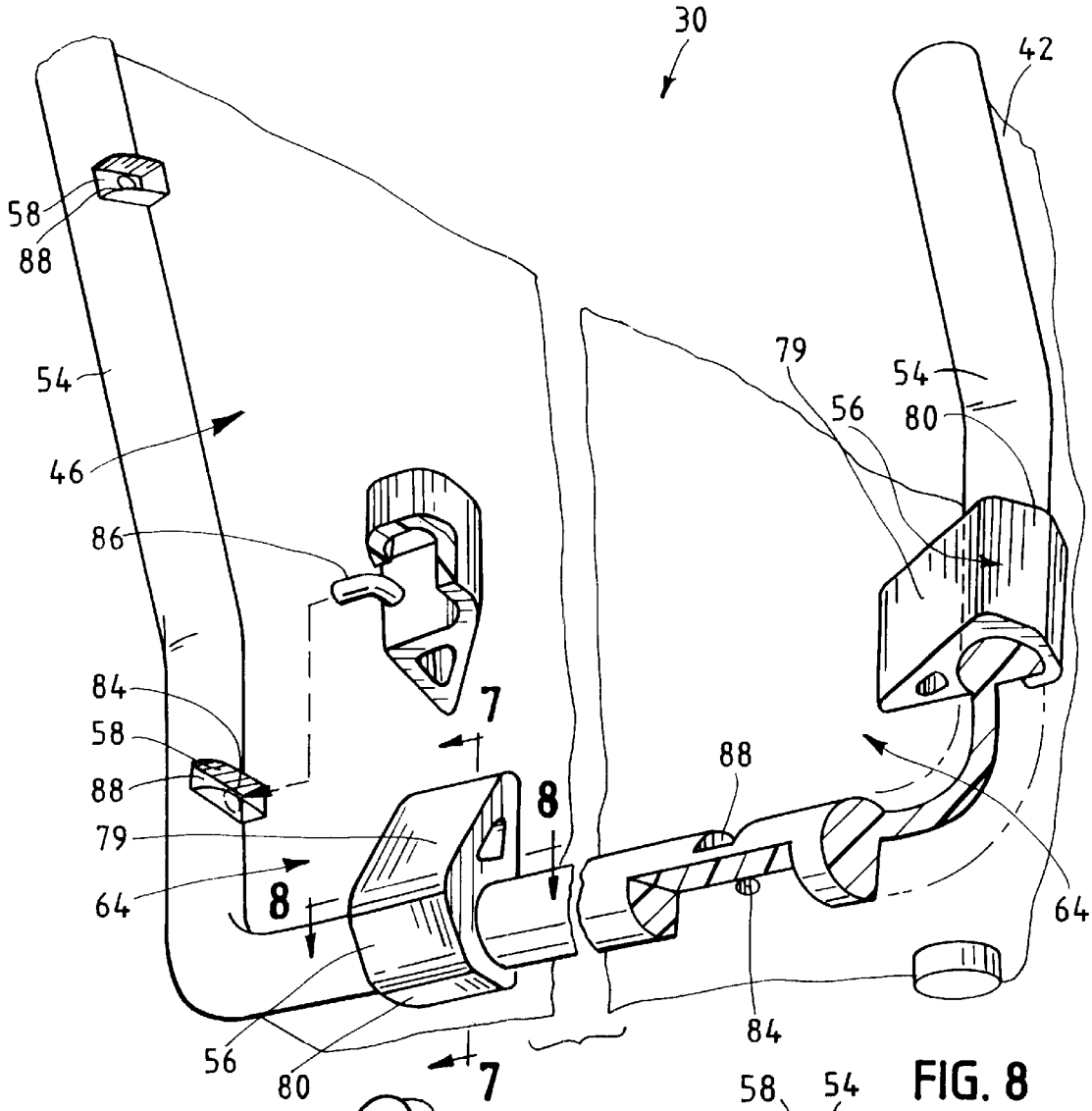
FIG. 6 is partial broken away view of the open end of the newspaper delivery receptacle illustrating the securement of the retainment members to corresponding engagement members positioned about the lip of the receptacle.

Referring now to FIG. 1, a newspaper delivery receptacle assembly 20 having a newspaper delivery receptacle 30 is shown being secured to a mounting post 32 by mounting bracket 34. The newspaper delivery receptacle 30 has a generally elongate tubular shape with a top wall 36, a bottom wall 38, a pair of vertical side walls (or sides) 40, 42 connecting the top wall and bottom wall, a back wall 44 and an open front end 46 for receipt of inserted items such as a newspaper 47, printed material and the like. The mounting bracket 34 is generally L-shaped, preferably having one portion securable by screws to the mounting post 32 and another portion securable to a mounting assembly 48 disposed at an exterior surface 50 of the bottom wall 38 of the delivery receptacle tube 30. The mounting assembly 48 has four guide members 52 extending from the exterior surface 50 which are each formed to abut with the mounting bracket 34 to reduce sliding movement of the bracket when affixed to the receptacle 30.

As seen in FIG. 1, a reinforcing lip 54 is disposed about the open front end 46 of the newspaper delivery receptacle 30. A plurality of retainment members 56 are securable to the newspaper delivery receptacle 30 for preventing an inserted item, such as newspaper 47, from being discharged through the open front end 46 of the receptacle. Preferably the plurality of engagement members 58 are selectively positionable at each of the vertical side walls 40, 42 and at the bottom wall 38 for mating engagement and securement of the retainment members 56 to the newspaper delivery receptacle 30. The retainment members 56 are releasably secured at the lip 54 proximate the open front end 46 of the receptacle 30. Additionally, formed within the body of the receptacle 30, at the bottom wall 38, is an elongate cambered bottom wall portion 60 which extends into an interior region 62 of the receptacle to elevate a newspaper 47 or other inserted item from the bottom wall 38 and prevent accumulated water, snow or moisture at the interior bottom surface of the receptacle from contacting the newspaper or other inserted items.

Referring now to FIGS. 2 and 3, the newspaper delivery receptacle 30 is shown having a cambered bottom wall portion 60 positioned at and extending along the length L of the bottom wall 38. As best seen in FIG. 2, the bottom wall portion 60 has a convex surface 62. The convex surface 62 of the bottom wall portion 60 projects from the bottom wall 38 into an interior region 64 of the receptacle 30. The cambered bottom wall portion 60 is preferably molded into the bottom wall 38 of the receptacle 30 with the convex surface 62 of the cambered bottom wall portion 60 formed to have at least a portion of a circular shape such as a semi-circular shape.

As seen in FIG. 3, the cambered bottom wall portion 60 substantially extends the length L of the bottom wall 38 and preferably extends more than three fourths (¾) the length of the bottom wall 38. The cambered bottom wall portion 60 is positioned at a central region 65 of the bottom wall 38 between the sides 40, 42 which define the width W, FIG. 2, of the receptacle 30. As seen in FIG. 2, the convex surface 62 of the cambered bottom wall portion 60 has a peak or apex 66 which is positioned between two opposing ends 67A, 67B of the bottom wall portion. The convex surface 62 is defined by the peak 66 and the two opposing ends 67A, 67B of the cambered bottom wall portion 60 and extends substantially along the length of the bottom wall 38 of the receptacle 30. The convex surface 62 of the cambered bottom wall portion 60 extends in a direction substantially parallel to the length L, FIG. 3, of the bottom wall 38.

A plurality of drainage holes 68, FIG. 3, are formed within the bottom wall 38. The drainage holes 68 are positioned between the cambered bottom wall portion 60 and at least one of the vertical sides 40, 42 of the receptacle 30. Preferably, drainage holes 68 are placed between the cambered bottom wall portion 60 and both sides 40, 42 of the receptacle 30 as seen in FIG. 3. The cambered bottom wall portion 60, FIG. 2, has a width W1 extending between ends 67A, 67B which is narrower than the width W of the bottom wall 38. The centrally located bottom wall portion width W1 is preferably less than one half (½) the width W of the bottom wall of the receptacle.

Referring to FIG. 4, a side edge 76 of the metal mounting bracket 34 is shown being held and restricted from lateral movement by guide member 52. The bottom wall 38 of the receptacle 30 has extended steps 71 arranged in a grate configuration (FIG. 5) at the mounting assembly at which the L-shaped member 52 further extends from. The step 71 and the guide member 52 engage the bracket 34 at its top and side edge 76 to limit movement of the bracket when affixed to the mounting assembly of the receptacle.

Referring now to FIG. 5, the mounting assembly 48 connected at the exterior surface 50 of the bottom wall 38 is shown being aligned for securement with the mounting bracket 34 and a bracket clip 70. The mounting assembly 48 has a support grate 71 of crossing members to provide a flat surface to position the mounting bracket thereon. The mounting assembly 48 also has a plurality of spaced apart snaps 72A–D, which extend from the exterior surface 50 at the bottom wall 38 of the receptacle 30. The mounting bracket 34 has a plurality of openings 73A–D which are similarly aligned and are positioned to engage the snaps to fixedly secure the receptacle 30 to the bracket 34.

Figure 12:
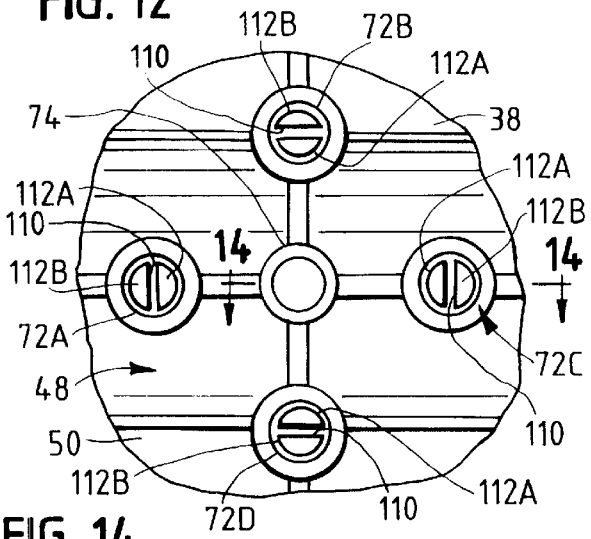
FIG. 12 is a partial broken away view of the mounting assembly having a plurality of snap members and a central guide post at the bottom exterior surface of the receptacle.

As seen in FIG. 5, the snaps 72A–D have two pairs of aligned snaps 72A, 72C and 72B, 72D. One pair of snaps 72A, 72C are aligned with each other in a direction of the open front end 46, FIG. 1, of the receptacle and another pair of snaps 72B, 72D are aligned with each other and are also aligned in a transverse direction to the alignment of the pair of snaps 72A, 72C. As best seen in FIG. 12, the one pair of snaps 72A, 72C are preferably aligned generally in a direction with the length of the receptacle and perpendicular to the alignment of the other pair of snaps 72B, 72D generally aligned in a direction with the width of the receptacle forming a generally crossing or +– configuration. The mounting bracket 38, FIG. 5, has four openings 73A–D for engagement in register with the two pairs of snaps 72A, 72C and 72B, 72D.

Figure 13:
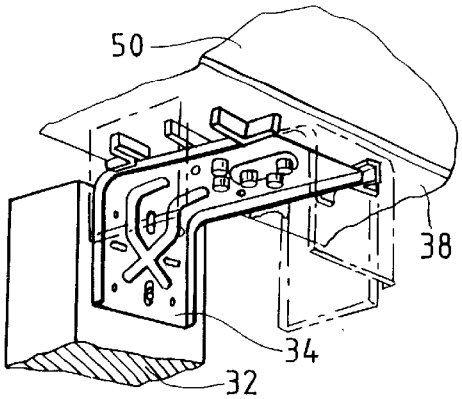
FIG. 13 is a partial broken away view illustrating the newspaper delivery receptacle being securable to the mounting bracket in four rectilinear directions.

In accordance with the present invention, each of the openings 73A–D are enabled to be inserted for engagement into each of the four snaps 72A–D such that the mounting bracket 34 is positionable in four different rectilinear directions for variable securement to the receptacle 30 as seen in FIGS. 5 and 13. For increased firm securement, the mounting assembly 48, FIG. 5, has a central guide post 74 connected to the exterior surface 50 of the receptacle bottom 38 and the mounting bracket 34 has a corresponding central opening 75 for engagement about the central guide post 74. As also seen in FIGS. 5 and 12, the mounting assembly 48 has four L-shaped guide members 52, spaced apart from snaps 72A–D, which are used to abut with the side edges 76 of the mounting bracket 34 to reduce sliding movement of the bracket in each one of the four different rectilinear directions at which the bracket is securable to the receptacle 30. Once the mounting bracket 34 is snapped into engagement with the mounting assembly 48 of the receptacle 30, the bracket clip 70 is employed for increased resistance and stability. The bracket clip 70 has a central engagement opening 77 for mounting about the central guide post 74 and a snap securement member 78 which is selectively engageable to any one of the snaps 72A–D.

Referring now to FIG. 6, the retainment members 56 are shown to be releasably secured to a plurality of corresponding engagement members 58 positioned at various locations about the lip 54 at the vertical side walls 40, 42 and bottom wall 38 proximate the open front end 46 of the receptacle 30. The retainment members or clips 56 are securable to the receptacle 30 and are used for preventing inserted items such as newspapers and mailings from being discharged through the open front end 46. The retainment members 56 have a top section 79 which is positioned to extend within the interior region 64 of the receptacle 30 and a bottom section 80 for securement about the lip 54 of the receptacle.

Figure 7:
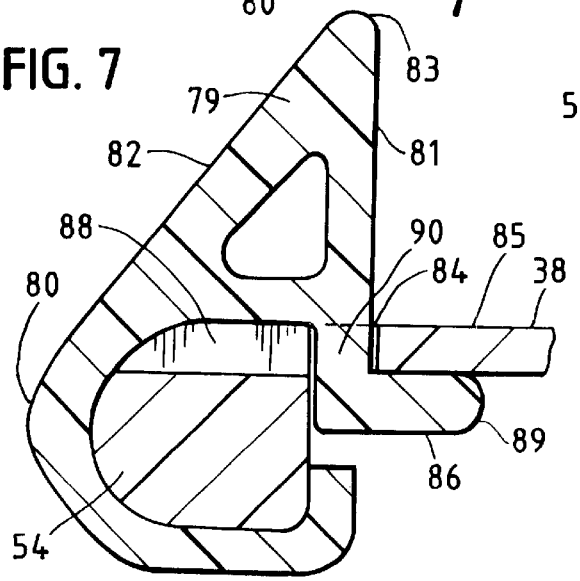
FIG. 7 is a cross sectional view of an engaged retainment member as viewed along line 7—7 of FIG. 6.

As seen in FIG. 7, the top section 79 has a vertical face section 81 for abutting with and containment of items stored in the receptacle tube 30. The top section 79 also has a slanted back section 82 which extends downwardly from the top 83 of the vertical face section 81 to the bottom section 80 of the retainment clip 56. As seen in FIGS. 6 and 7, the bottom section 80 of the retainment clip 56 has a generally C-shaped flange 87 for securement about the lip 54 of the receptacle 30.

As will be explained in greater detail with reference to FIGS. 9–11, the retainment clip 56 is releasably secured to the lip 54 about the bottom wall 38 and vertical side walls 40, 42 by snapping the retainment clip into selected engagement members 58. The engagement members 56 each have a slot 88 and a mounting hole 84 proximate the open front end 46 of the receptacle 30. As seen in FIGS. 7–11, the mounting hole 84 extends completely through the body of the receptacle 30 from the interior surface 85 to an exterior surface 50 of the receptacle.

The retainment members 56 each have a generally elongate L-shaped wedge 86 which is inserted into the mounting hole 84. As seen in FIGS. 9–11, the L-shaped wedge 86 is insertable into the mounting hole 84 at the interior surface 85 of the receptacle 30. The vertical face 81 of the retainment member 56 is placed flat (by a thumb of a user) against the interior surface 85, FIG. 9, and the L-shaped wedge 86 is placed in the mounting hole 84. The retainment clip 56 is pulled back, as seen in FIG. 10, such that the wedge 56 slides through the hole 84 for engagement with the exterior surface 50 of the receptacle 30. As the retainment clip 56 is pulled back, FIG. 10, with the wedge 86 inserted into the mounting hole 84, the C-shaped flange 87 snaps into snug securement about the rounded contour of the reinforcing lip 54 of the receptacle 30, as seen in FIG. 11. Having the L-shaped wedge 86, FIG. 11, abutting the exterior surface 50 while also having the top section 79 mounted atop the interior surface 85 of the receptacle 30 provides an added measure of securement of the retainment member to the receptacle.

In accordance with the present invention, the retainment members 56 as seen in FIGS. 1 and 6, may be selectively arranged for securement at the respective engagement members 58 to meet the desires and needs of the user. The various arrangements about the lip 54 of the receptacle include placing at least one retainment clip 56 on at least one of the pair of vertical side walls 40, 42. One or more retainment clips 56 are generally secured with the engagement members 58 at both the vertical side walls 40, 42 and the bottom wall 38 of the receptacle 30. Preferably, a plurality of retainment members 56 are secured to the plurality of engagement members positioned at both of the vertical side walls 40, 42 and a plurality of engagement members are also positioned at the bottom wall 38. By securing many retainment clips 56 about the lip 54 at the vertical walls 40, 42 and bottom wall 38, inserted items are contained within the receptacle and are prevented from being expelled out the sides or sliding out the bottom of the receptacle.

Figure 8:
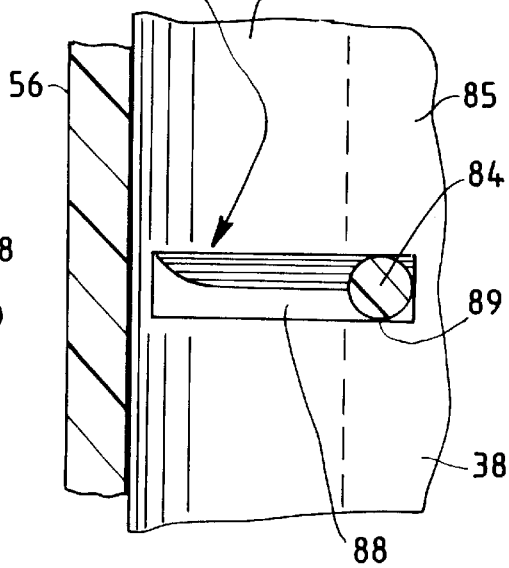
FIG. 8 is a top cross sectional view as viewed along line 8—8 of FIG. 6.
Figure 9:
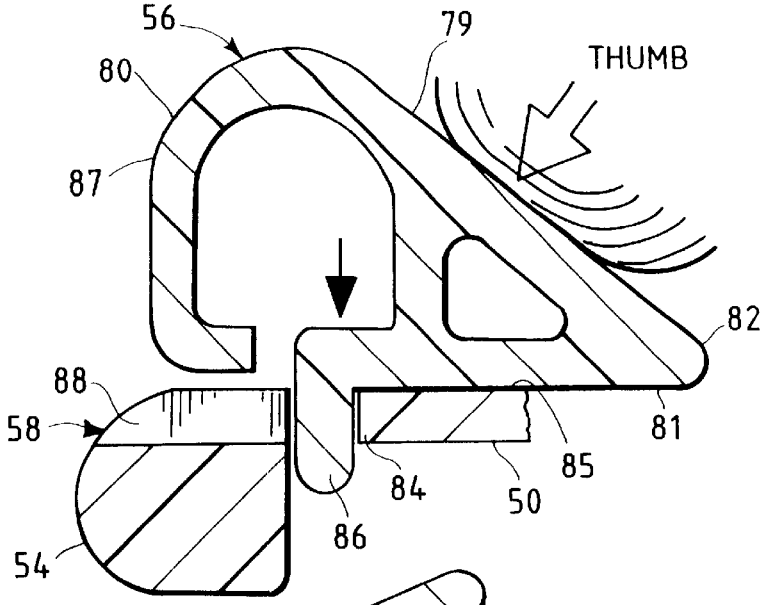
FIGS. 9–11 illustrate the process of securing a retainment member to a corresponding engagement member formed in the body of the receptacle.
Figure 10:
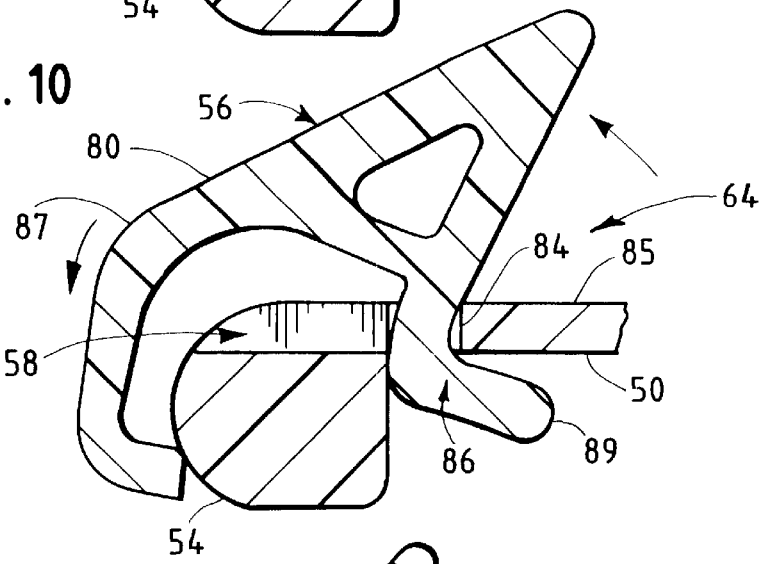
Figure 11:
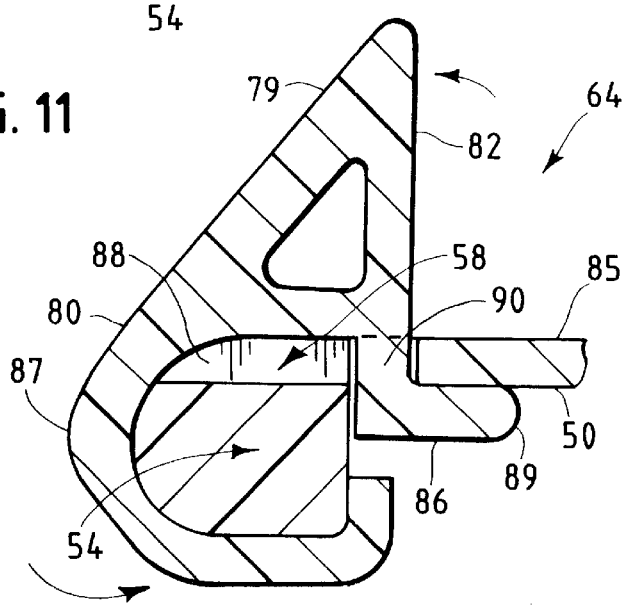

As seen in FIGS. 6–11, each of the plurality of engagement members 58 have a corresponding plurality of slots 88 which are positioned at the lip 54, FIG. 6, and formed to extend to the vertical side walls 40, 42 and the bottom wall 38 proximate the open front end 46 of the receptacle 30. As seen in FIG. 8, at least part 89 of the slot 88 is formed to extend beyond the lip 54 of the receptacle. The cut portion of the slot 88 which extends beyond the lip 54 forms the mounting hole 84. Thus, the mounting hole 84, FIG. 7, which extends from the interior surface 85 to the exterior surface 50 through the body of the receptacle is established at the part of the slot 88 which extends beyond the lip 54. When securing the retainment clips 56, the generally elongate L-shaped wedges 86 of the retainment clips are guided into the slots 88, FIG. 6, at the desired preselected locations about the receptacle lip 54. The wedge 86 is slidably inserted into the mounting hole 84 of the slot 88 with the vertical face section 79 of the clip 56 lying on the interior surface 85 of the receptacle 30, as seen in FIG. 9. The retainment clip 56 is pulled back, in FIG. 10, such that an elongate extension 89 of the L-shaped wedge 86 engages the exterior surface 50, FIG. 11, and a shorter connection branch 90 of the wedge 86 which engages the top portion 79 of the clip 56, sits in the mounting hole 84. The C-shaped flange 87, FIG. 11, is connected about the lip 54 of the receptacle 30 when the retainment member 56 is pulled back as the top portion 79 extends into the interior region 64 of the receptacle 30.

Figure 14:
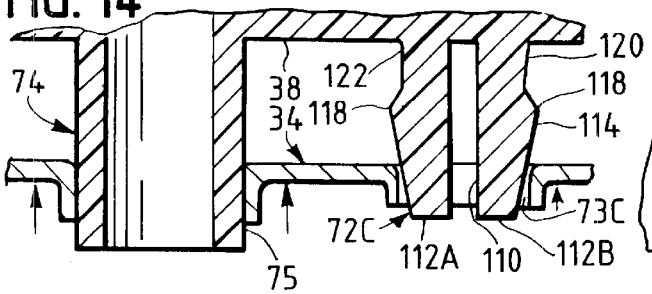
FIG. 14 is a cross sectional view of the mounting bracket being placed about a snap and central guidepost of the mounting assembly of the receptacle.
Figure 15:
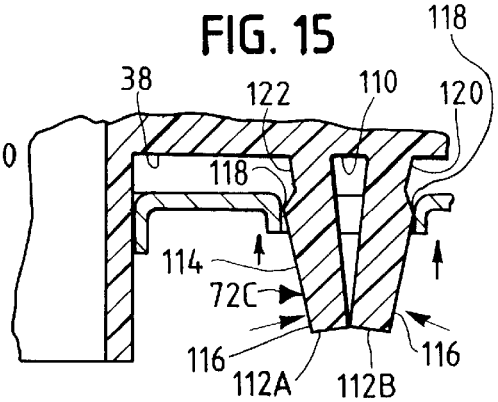
FIG. 15 is a cross sectional view illustrating the snap being compressed as the mounting bracket is being secured to the mounting assembly of the receptacle.
Figure 17:
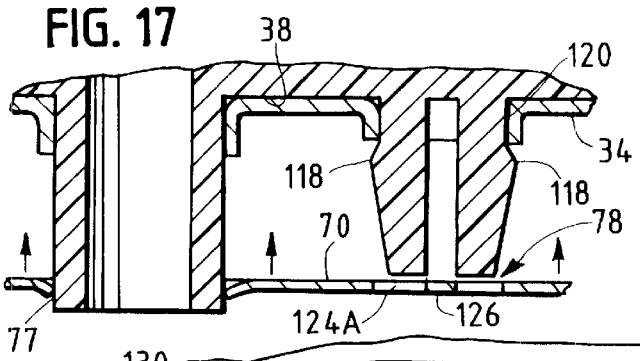
FIG. 17 is a cross sectional view of the mounting bracket mounted to the mounting assembly and the bracket clip positioned to be secured to the mounting assembly.

Referring now to FIG. 12, the securement snaps 72A–72D secured to the exterior surface 50 at the bottom wall 38 of the receptacle are shown positioned about the central guide post 74 of the mounting assembly 48. As seen in FIG. 12, each of the snaps 72A–72D are spaced substantially equidistant from the central guide post 74. The central guide post 74 is positioned between each of the aligned pairs of snaps 72A, 72C and 72B, 72D in which the pairs of snaps are aligned perpendicular to each other such that they are arranged in a generally +– configuration. The central guide post 74 is preferably a circular shaped member which extends beyond the snaps 72A–D (as seen in FIGS. 14, 15 and 17) from the exterior surface 50 of the receptacle in order to provide a guide for the central opening 75 as the mounting bracket 34 is slid onto the mounting assembly 48. The snaps 72A–D are generally compressible in which each snap has a centrally located recess 110 dividing the snap into two conical segments 112A, 112B. As seen in FIG. 13, the compressible snaps 72A–D are arranged relative to the guide 74 to engage and secure the central opening 75 and the correspondingly arranged openings 73A–D of the mounting bracket 34 such that the bracket is advantageously enabled to be selectively placed in four different rectilinear positions.

Referring to FIGS. 14, 15 and 17, snap 72C is shown with central recess 110 dividing the snap into two aligned and facing segments 112A, 112B. The separate segments 112A, 112B form a conical shaped portion 114 in which the segments are tapered from a relatively narrow end 116 to a relatively wide end 118 at the conical shaped portion of the snap. The two segments 112A, 112B of snap 72C are movable between a compressed position (as seen in FIG. 15) and an extended or relaxed position (as seen in FIGS. 14 and 17). Additionally, snap 72C, as seen in FIGS. 14, 15 and 17, has a seat 120 with a neck member 122 proximate the relatively wide end 118 of the segments 112A, 112B for engagement with a corresponding opening 73C of the mounting bracket 34 upon insertion of the openings through the snaps of the receptacle. As seen in FIGS. 14 and 15, the two segments 112A, 112B of the conical shaped portion 114 of the snaps are compressed together reducing the size of the recess 110 (FIG. 15) upon insertion of the openings 73A–D of the mounting bracket 34. The recess 110 is compressed until the openings 73A–D (FIG. 5) of the mounting bracket 34 are positioned in their corresponding seat members about the snaps 72A–B. FIGS. 14, 15 and 17 are illustrative of only one snap 72C upon engagement with the mounting bracket, however, it will be appreciated that the other snaps 72A, 72B and 72D have the same structural properties and operate in to affix the mounting bracket in the same manner.

FIGS. 14, 15 and 17 illustrate the securement of the mounting bracket 34 and bracket clip 70 to the mounting assembly 48 at the bottom wall 38 of the receptacle. In FIG. 14, the central opening 75 and the opening 73C of the bracket 34 are slid onto the central guide post 74 and snap 72C respectively. The bracket opening 73C is moved along the conical shaped portion 114 of the snap from the relatively narrow end 116 toward the relatively wide end 118. As seen in FIG. 15, as the bracket 34 is guided toward the wide end 118 proximate the seat 120, the snap compresses such that the conical snap segments 112A, 112B move toward each other and, in turn, reducing the area of the recess 110 therebetween. The walls of the opening 73C of the bracket 34 press against the outer surface of the conical shaped portion 114 to compress the snap.

As seen in FIG. 17, once the bracket 34 is moved beyond the wide end 118 of the conical portion 114, the opening 73C is positioned in the seat 120 of the snap 72C with the opening surrounding the neck 122 at the snap seat. When the bracket opening is positioned in the seat 120, the resilient conical snap segments 112A, 112B (preferably formed of the same plastic material as the molded receptacle tube) spring back into their relaxed or extended position locking the bracket 34 to the mounting assembly 48 of the receptacle. For increased securement and resistance, the bracket clip 70, FIG. 17, is then slid onto the central guide post 74 and one of the snaps to maintain the snap in the extended locking position. The central engagement opening 77 of the bracket clip 70 is positioned over and slid about the guide post 74 and the snap securement member 78 having snap segment openings 124A, 124B and a central dividing wedge 126 engage the conical segments 112A, 112B to hold the snap in the extended position. The wedge 126 is inserted into the recess 110 to maintain the segments 112A, 112B in an outwardly divided position as the corresponding snap segment openings 124A, 124B are placed about the conical shaped portion of the snap.

Figure 16:
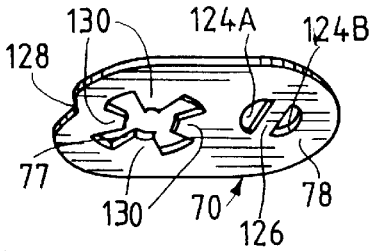
FIG. 16 is a perspective view of the bracket clip of the present invention.
Figure 18:
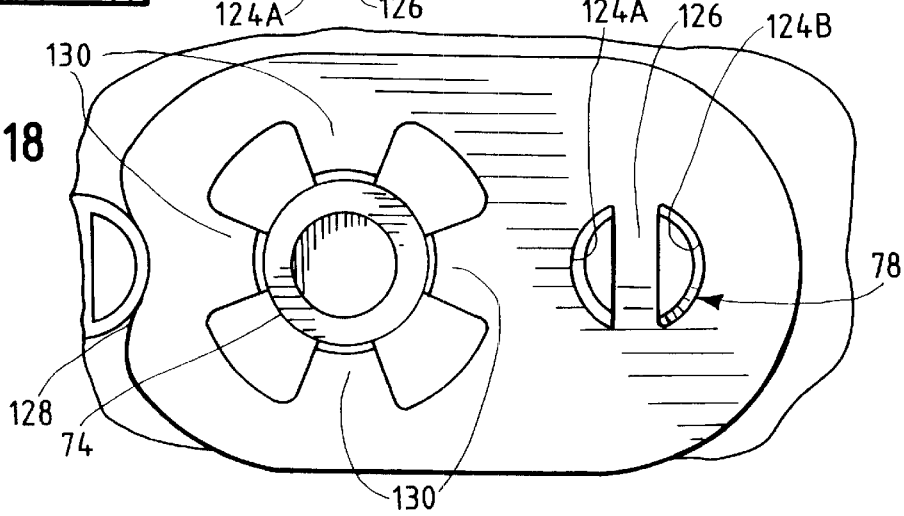
FIG. 18 is a bottom view of the bracket clip engaged with a snap and the central guide post of the mounting assembly of the receptacle.

Referring to FIGS. 16 and 18, the bracket clip 30 has a central engagement opening 77 for mounting about the guide post 74 and a snap securement member 78 which engages with expanded and divided snap segments 112A, 112B. The snap securement member 78 has a pair of snap segment openings 124A, 124B for engagement about the conical shaped segment members 112A, 112B of a selected snap and further has a wedge 126 insertable into the associated snap recess 110 to maintain the segments 112A, 112B of the snap in the extended position. The bracket clip 70 has a curved edge portion 128 opposite the snap securement member 78 for abutting against on opposingly aligned snap. The central engagement opening 77 is defined by a plurality of extended fingers 130 cut in the body of the clip 70 for frictional engagement about the circumference of the central guide post 74. By maintaining the snap in the extended position and being secured about the central guide post 74, the bracket clip 70 provides added securement of the mounting post 34 to the mounting assembly of the receptacle 30.

While a detailed description of the preferred embodiment of the invention has been given, it should be appreciated that many variations can be made thereto without departing from the scope of the invention asset forth in the appended claims.

What is claimed is:

1. A newspaper delivery receptacle assembly with a newspaper delivery receptacle having a generally elongated tubular shape and in which the receptacle is securable to a mounting post, comprising:

a plurality of spaced apart snaps which extend from an exterior surfacer of the receptacle in which the newspaper delivery receptacle has an open front end and in which the plurality of spaced apart snaps include two pairs of snaps with one pair of snaps aligned with each other in a direction of the open front end of the receptacle and another pair of snaps aligned transverse to the one pair of snaps; and a mounting bracket having a plurality of openings which engage the snaps to fixedly secure the receptacle to the bracket in which the mounting bracket has at least four openings for engagement in register with the two pairs of snaps such that the mounting bracket is positionable in four different directions for securement to the receptacle.

2. The newspaper delivery receptacle assembly of claim 1 in which the one pair of snaps are aligned perpendicular to the alignment of the other pair of snaps.

3. The newspaper delivery receptacle assembly of claim 2 including a central guide post positioned between each of the pairs of snaps and in which the mounting bracket has a corresponding central opening for engagement about the central guide post.

4. The newspaper delivery receptacle assembly of claim 3 in which the central guide post is a circular shaped member extending beyond the snaps from the exterior surface of the receptacle.

5. The newspaper delivery receptacle assembly of claim 3 in which each of the plurality of snaps are spaced substantially equidistant from the central guide post.

6. The newspaper delivery receptacle assembly of claim 3 including a plurality of guide members spaced apart from the snaps and extending from the exterior surface of the receptacle in which each of the guide members are formed to abut with the mounting bracket to reduce sliding movement of the mounting bracket.

7. The newspaper delivery receptacle assembly of claim 6 in which the plurality of guide members include four L-shaped guide members which abut with side edges of the mounting bracket in each of the four different directions for securement to the receptacle.

8. The newspaper delivery receptacle assembly of claim 3 in which the snaps have a compressible conical shaped portion and a recess dividing the snap into two conical segments such that the two segments are compressed together, reducing the recess upon insertion of the openings of the mounting bracket though the snaps until the openings are positioned in corresponding seat members of the snaps.

9. The newspaper delivery receptacle assembly of claim 1 in which the snaps have a central recess dividing the snaps into two segments movable between a compressed position and an extended position.

10. The newspaper delivery receptacle assembly of claim 9 in which the segments form a conical shaped portion and in which the segments are tapered from a relatively narrow end to a relatively wide end.

11. The newspaper delivery receptacle assembly of claim 10 in which the snaps have a seat with a neck member proximate the relatively wide end of the segments for engagement with corresponding openings of the mounting bracket with the insertion of the snaps through the openings of the bracket.

12. A newspaper delivery receptacle assembly with a newspaper delivery receptacle having a generally elongated tubular shape and in which the receptacle is securable to a mounting post, comprising:

a plurality of spaced apart snaps which extend from an exterior surface of the receptacle in which the snaps have a central recess dividing the snaps into two segments movable between a compressed position and an extended position, in which the segments form a conical shaped portion and in which the segments are tapered from a relatively narrow end to a relatively wide end;

a mounting bracket having a plurality of openings which engage the snaps to fixedly secure the receptacle to the bracket; and a bracket clip having a central opening for mounting about a central guide post and a snap securement member having snap segment openings for engagement about the two divided segments of the snap and a wedge insertable into the recess to maintain the two segments of the snap in the extended position.

13. A newspaper delivery receptacle having a generally elongate tubular shape with a bottom wall, top wall and sides and an open front end for receipt of newspapers, printed material and the like, the newspaper delivery receptacle comprising:

a cambered bottom wall portion positioned at and extending along a length of the bottom wall in which a width of the cambered bottom wall portion is less than one half (½) a width of the bottom wall of the receptacle; and a convex surface of the bottom wall portion such that the convex surface projects from the bottom wall into an interior region of the receptacle, the convex surface of the cambered bottom wall portion has an apex positioned between two opposing ends of the cambered bottom wall portion and in which the convex surface defined by the apex and the two opposing ends of the cambered bottom wall portion extends substantially along the length of the bottom wall of the receptacle and the convex surface of the cambered bottom wall portion extends in a direction substantially parallel to the length of the bottom wall of the receptacle.

14. A newspaper delivery receptacle having a generally elongate tubular shape with a bottom wall, a top wall, a pair of vertical side walls connecting the top wall and bottom wall, a back wall and an open front end for receipt of inserted items such as newspapers and printed material, the newspaper delivery receptacle comprising:

a plurality of retainment members securable to the newspaper delivery receptacle for preventing an inserted item from being discharged through the open front end of the receptacle; and a plurality of engagement members positioned at both of the vertical side walls and another plurality of engagement members positioned at the bottom wall including a plurality of slots formed in the vertical side walls and the bottom wall proximate the open front end of the receptacle for releasably securing the retainment members to the newspaper delivery receptacle.

15. The newspaper deliver receptacle of claim 14 including a lip at the vertical side walls and the bottom wall disposed about a perimeter of the open front end of the receptacle and in which the plurality of slots are positioned at the lip of the receptacle.

16. The newspaper delivery receptacle of claim 15 in which at least a part of the slot is formed to extend beyond the lip toward the interior of the receptacle such that a mounting hole through the receptacle is established at the part of the slot which extends beyond the lip.

17. The newspaper delivery receptacle of claim 16 in which the plurality of retainment members have a top section for positioning within an interior region of the receptacle and a bottom section for securement about the lip of the receptacle.

18. The newspaper delivery receptacle of claim 17 in which the bottom section of the retainment member has a generally C-shaped flange for securement about the lip of the receptacle.

19. The newspaper delivery receptacle of claim 18 in which the retainment member has a generally elongate L-shaped wedge secured to the top section for slideable insertion into the mounting hole of the slot proximate the open front end of the receptacle.

20. The newspaper delivery receptacle of claim 18 in which the top section of the retainment member has a substantially vertical face section for containment of inserted items within the receptacle and a slanted back section extending downwardly from a top of the vertical face section to the generally C-shaped flange.

21. The newspaper delivery receptacle of claim 14 including a lip positioned about the bottom wall and vertical side walls at the open front end of the receptacle and in which the retainment members have a flange for releasable securement about the lip of the receptacle.

22. The newspaper delivery receptacle of claim 21 in which the flange is generally C-shaped for engagement about the lip and the receptacle.

23. The newspaper delivery receptacle of claim 21 in which the engagement members have a mounting hole proximate the open front end of the receptacle extending from an interior surface to an exterior surface of the receptacle and in which the retainment members have a generally L-shaped wedge insertable into the mounting hole for engagement with the exterior surface of the receptacle.

24. A method of assembling a newspaper delivery receptacle having a generally elongate tubular shape with a bottom wall, a top wall, a pair of vertical side walls connecting the top wall and bottom wall, a back wall and a lip disposed about an open front end of the receptacle which receives inserted newspapers and printed material, comprising the steps of:

providing the newspaper delivery receptacle with a releasably securable retainment member for preventing an inserted item from being discharged through the open front end; and releasably securing the retainment member to the lip proximate the open front end of the receptacle including snapping the retainment member into an engagement member for securement about the lip of the receptacle.

25. The method of claim 24 including the step of selectively positioning a plurality of retainment members at desired locations at the vertical side walls and the bottom wall.

26. The method of claim 25 including the steps of forming a plurality of slots at different preselected locations about the lip at the bottom wall and the vertical side walls of the receptacle, and guiding a generally L-shaped wedge of the plurality of retainment members into the slots at the different preselected locations.

27. The method of claim 24 including the step of connecting a C-shaped flange of the retainment member about the lip of the receptacle.

28. The method of claim 27 in which the retainment member has a top section with a vertical face section and with a slanted back section extending to a bottom section having the C-shaped flange, and including the step of positioning the top section into an interior of the receptacle with the vertical face section facing toward the interior and the slanted back section facing the open front end.

29. The method of claim 27 including the step of inserting a generally L-shaped wedge of the retainment member into a mounting hole proximate the open front end and extending from an interior surface to an exterior surface of the receptacle such that the generally L-shaped wedge engages with the exterior surface of the receptacle.

* * * * *

UNITED STATES PATENT AND TRADEMARK OFFICE

CERTIFICATE OF CORRECTION

PATENT NO. : 6,402,023 B1 
DATED : June 11, 2002
INVENTOR(S) : Joseph M. Beaudry and Thomas P. Hamilton It is certified that error appears in the above-identified patent and that said Letters Patent is hereby corrected as shown below:

Title page,
Item [57], ABSTRACT,
Line 3, after "walls" insert -- and --;
Line 4, change "printer" to -- printed --;
Line 6, change "space" to -- spaced --;

Column 1,
Line 22, after "disadvantages." change "In" to -- It --;

Column 8,
Line 9, change "surfacer" to -- surface --; and
Line 54, after "bracket" change "though" to -- through --;

Signed and Sealed this

Eighteenth Day of February, 2003

JAMES E. ROGAN
*Director of the United States Patent and Trademark Office*